US005605224A

United States Patent [19]

Seymour et al.

[11] Patent Number: 5,605,224

[45] Date of Patent: Feb. 25, 1997

[54] ACCESSORY COMPARTMENT FOR HIGH AMPERE-RATED CIRCUIT BREAKER

[75] Inventors: Raymond K. Seymour; Paul T. Rajotte, both of Plainville; Paul H. Singer, West Hartford; John A. Pollman, Seymour, all of Conn.

[73] Assignee: General Electric Company, New York, N.Y.

[21] Appl. No.: 248,900

[22] Filed: May 25, 1994

[51] Int. Cl.[6] ..... H01H 23/00

[52] U.S. Cl. ..... 200/401; 361/93

[58] Field of Search ..... 200/400, 401; 361/93, 91, 96, 97

[56] References Cited

U.S. PATENT DOCUMENTS

| | | | |
|---|---|---|---|
| 2,581,181 | 1/1952 | Favre . | |
| 4,672,501 | 6/1987 | Bilac et al. . | |
| 4,728,914 | 3/1988 | Morris et al. . | |
| 4,870,531 | 9/1989 | Danek . | |
| 5,172,293 | 12/1992 | Matsumoto et al. | 361/93 |
| 5,303,113 | 4/1994 | Goleman et al. | 361/93 |
| 5,539,168 | 7/1996 | Linzenich | 200/303 |

OTHER PUBLICATIONS

Santos et al "Digital Circuit Interrupter with Multiple Accessory Function" U.S. Ser. No. 08/239822 filed May 9, 1994.

Seymour et al "Electronic Trip Assembly for High Ampere–Rated Circuit Breaker" U.S. Ser. No. 08/248,908 filed May 25, 1994.

Pollman et al "Bell Alarm and Lock–Out for High Ampere–Rated Circuit Breakers" U.S. Ser. No. 08/248,910 filed May 25, 1994.

*Primary Examiner*—David J. Walczak

*Attorney, Agent, or Firm*—Richard A. Menelly; Carl B. Horton

[57] ABSTRACT

This invention relates to a high ampere-rated circuit breaker which meets the electrical code requirements of the world market. The circuit breaker electronic trip unit is contained within a recess in the circuit breaker cover and is interlocked with the circuit breaker operating mechanism to articulate the operating mechanism upon removal. The accessory units are contained within an adjoining accessory compartment recess within the circuit breaker cover. Rejection pins on the accessories insure that the correct accessories are connected within the corresponding accessory compartments.

17 Claims, 4 Drawing Sheets

ACCESSORY COMPARTMENT FOR HIGH AMPERE-RATED CIRCUIT BREAKER

BACKGROUND OF THE INVENTION

U.S. Pat. No. 4,672,501 entitled "Circuit Breaker and Protective Relay Unit" describes the use of a digital circuit interrupter employing a microprocessor in combination with ROM and RAM memory elements to provide both relaying as well as protection function to an electrical distribution system. The associated electronic trip unit is contained on printed circuit cards that are positioned within a recess in the digital circuit interrupter cover.

U.S. Pat. No. 4,870,531 entitled "Circuit Breaker with Removable Display and Keypad" describes a digital display and keypad used to select circuit breaker trip settings and allows the settings to be viewed.

U.S. patent application Ser. No. 08/239,822 entitled "Digital Circuit Interrupter with Multiple Accessory Function" describes an integrated circuit breaker having several accessory functions along with automatic overcurrent protection, which allows selection between the various accessory functions in different combinations. Separate switches arranged on the circuit interrupter trip unit allow factory as well as field selection of the accessory function combinations. The selected accessory units are inserted in the circuit interrupter cover adjacent to the trip unit.

U.S. patent application Ser. No. 08/248,908 entitled "Bell Alarm and Lock-out Accessory for a Circuit Interrupter" describes one such accessory unit used within the aforementioned "Circuit Interrupter with Multiple Accessory Function".

One purpose of the instant invention is to provide an arrangement whereby several accessory units can be electrically-connected with the circuit breaker trip unit. An additional purpose is to interlock the circuit breaker trip unit with the circuit breaker operating mechanism. A further purpose of the invention is to insure that the accessory units are properly interconnected within the trip unit circuit.

SUMMARY OF THE INVENTION

The circuit breaker electronic trip unit controlling a high ampere-rated circuit breaker is contained within a recess in the circuit breaker cover and is interlocked with the circuit breaker operating mechanism by means of a support platform to articulate the operating mechanism upon removal. The circuit breaker accessory units are mounted on the same support platform. Rejection pins on the accessories insure that the correct accessories are connected within the corresponding accessory compartments.

DESCRIPTION OF THE PREFERRED EMBODIMENT

Figure 1:
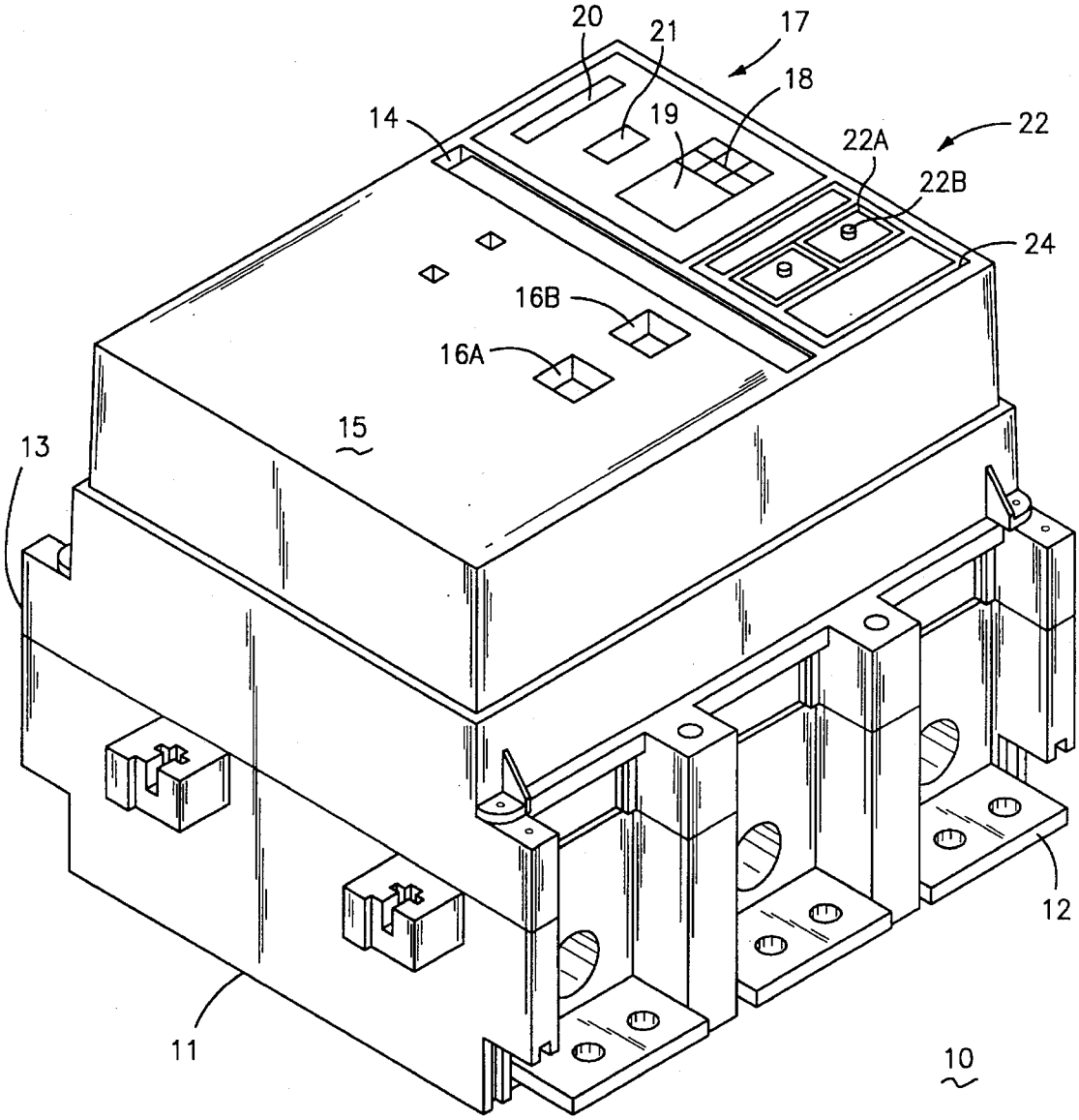
FIG. 1 is a top perspective view of a high ampere-rated circuit breaker containing the electronic trip unit and accessory modules compartment according to the invention.

The high ampere-rated circuit breaker 10 shown in FIG. 1 is capable of transferring several thousand amperes quiescent circuit current at several hundred volts potential without overheating. The circuit breaker consists of an electrically insulated base 11 to which an intermediate cover 13 of similar insulative material is attached prior to attaching the top cover 15, also consisting of an electrically-insulative material. Electrical connection with the interior current-carrying components is made by load terminal straps 12 extending from one side of the base and line terminal straps (not shown) extending from the opposite side thereof. The interior components are controlled by an electronic trip unit 17 contained within a recess 24 in the top surface of the top cover 15. The trip unit is similar to that described within the aforementioned U.S. Pat. No. 4,870,531 and interacts with the accessories 22 contained within said recess, such as the bell alarm and lock-out accessory 22A described within U.S. patent application Ser. No. 08/248,910 entitled "Bell Alarm and Lock-out Accessory for High Current Circuit Breakers" which includes a combined indicator and reset button 22B extending from the top thereof. The trip unit includes a display 19 for indicating the stored trip parameters along with the nature and time of the trip occurrence. The key pad 18 allows the circuit breaker memory elements to be accessed for the trip parameters. The rating plug 21 allows the circuit breaker ampere rating to be set in the manner described within U.S. Pat. No. 4,728,914. A battery compartment cover 20 allows access to the auxiliary power batteries as described within the aforementioned U.S. patent application Ser. No. 08/200,048 filed Feb. 22, 1994 entitled "Digital Circuit Interrupter with Battery Back-up Facility". An operating handle 14 provides means for manually resetting the circuit breaker operating mechanism after a circuit interruption as well as for moving the circuit breaker contacts between their OPEN and CLOSED positions. Buttons 16A, 16B allow the operator to open and close the circuit breaker operating mechanism.

Figure 2:
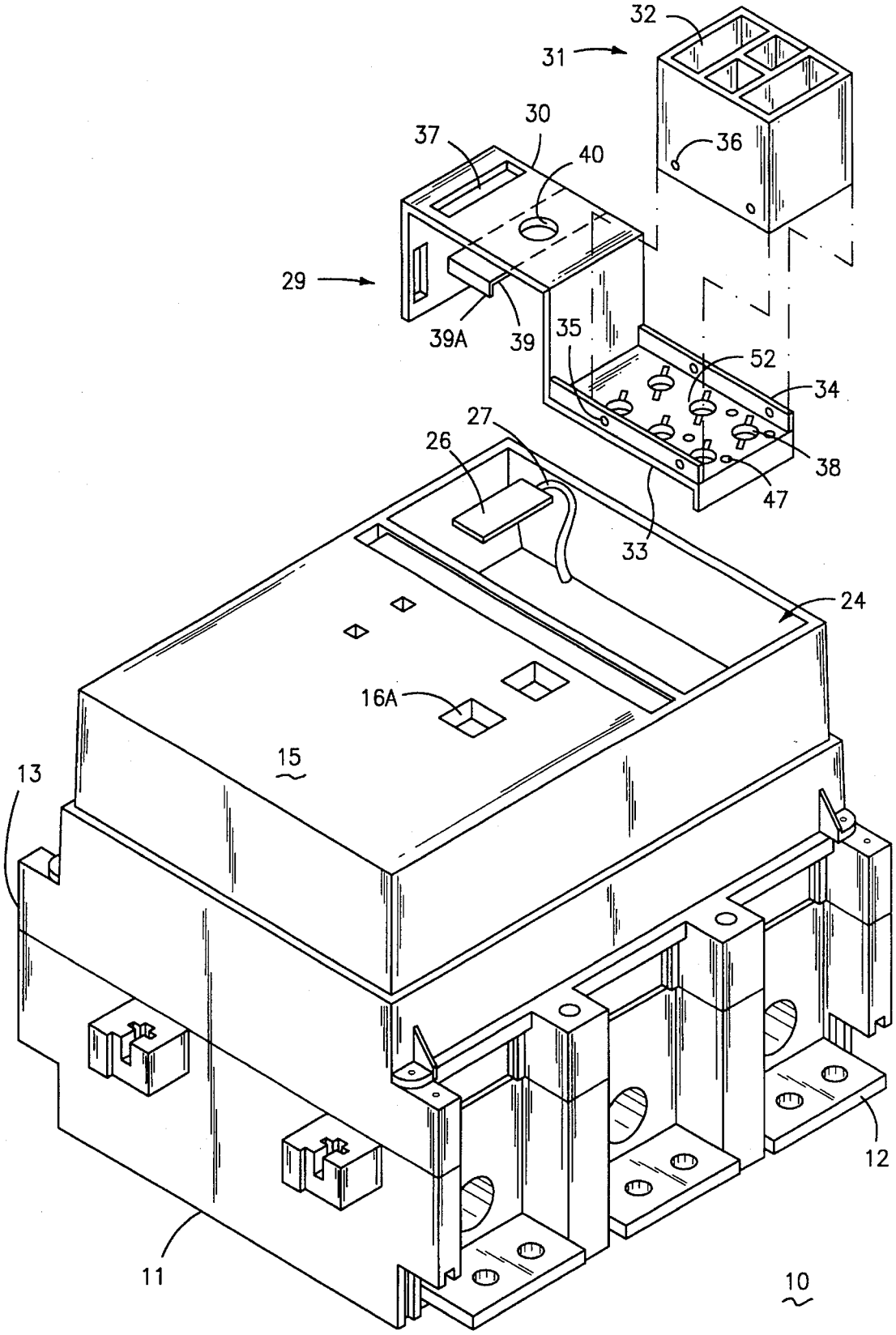
FIG. 2 is a top perspective view of the circuit breaker of FIG. 1 with the trip unit and accessory modules support assembly in isometric projection.
Figure 4:
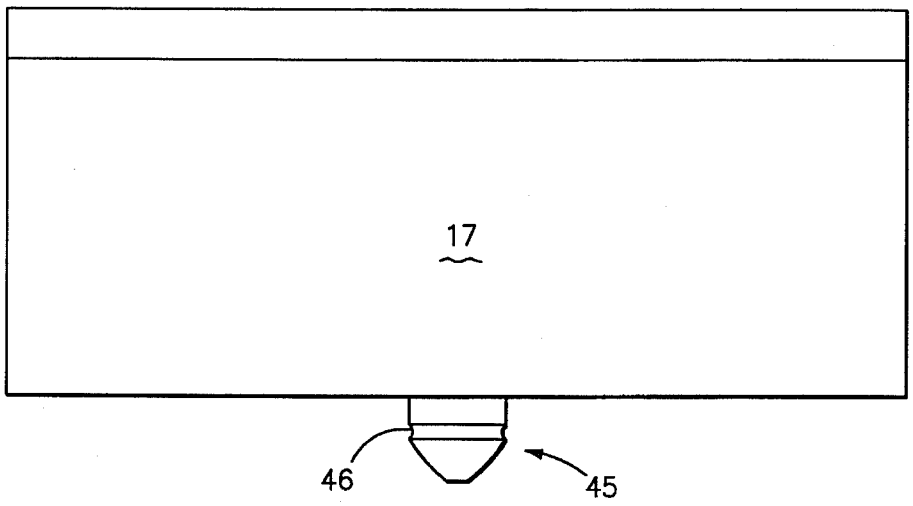
FIG. 4 is a side view of the trip unit depicted in FIG. 1.

The circuit breaker 10 is shown in FIG. 2 with the trip unit 17 and accessories 22 removed from the recess 24. Electrical connection between the circuit breaker electrical components and the trip unit is made by means of the terminal receptacle 26 and the wire hardness 27. Electrical connection between the electrical components and the accessories are made by means of the individual receptacles 28 inserted into holes 38 in the support platform 52. The accessories-trip unit support 29 includes a top support platform 30 which receives the trip unit 17 (FIG. 1). The terminal receptacle 26 is inserted within the elongated slot 37 formed in the top surface of the platform and trip unit retainer aperture 40 is formed to receive the retainer stud 45 extending from the rear of the trip unit as shown in FIG. 4. Referring back to FIG. 2, a trip unit retainer slide 39 is arranged on the bottom surface of the platform and is manually accessible by means of the downwardly depending tab 39A. The accessory housing 31 includes compartments that are open at the top and bottom. When the accessory housing is positioned on the bottom support platform 52, the individual compartments overlie corresponding connector receptacles 28 as well as the rejection apertures 47. The accessory housing is attached to the bottom support platform by means of the thru-holes 35 within the front and rear rims 33, 34 and the thru-holes 36 within the bottom of the accessory housing and screws or other suitable fasteners.

Figure 3A:
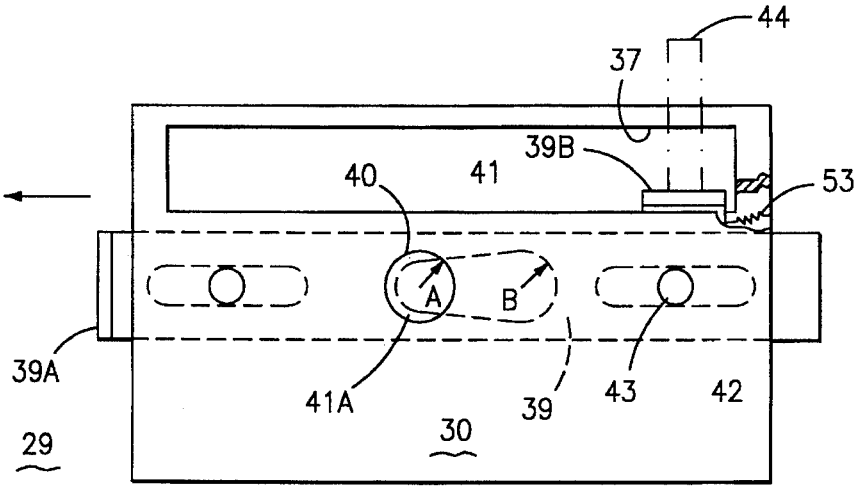
FIGS. 3A, 3B are top plan views of the circuit breaker tip unit interlock arrangement on the trip unit and accessory modules support assembly of FIG. 1.
Figure 3B:
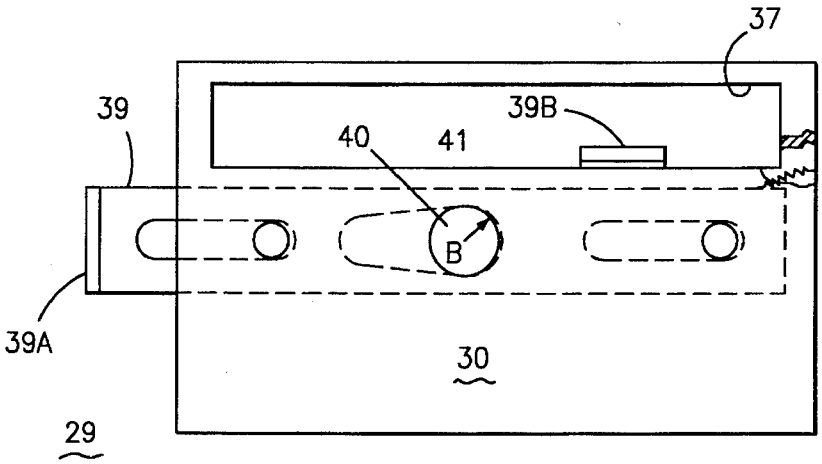

The interlock between the trip unit and the circuit breaker operating mechanism is best seen by referring jointly to FIG. 3A, FIG. 3B and FIG. 4. In FIG. 3A, the retainer slide 39 is in the lock-out position. The slide is carried by means of studs 43 and elongated slots 42 and is biased to the lock-out position by means of the extension spring 53. The key-hole shaped slot 41 formed in the central part of the slide defines a first diameter A and a larger diameter B. In the lock-out position, a part of the slide as shown at 41A blocks the retainer aperture 40 and thereby prevents insertion of the retainer stud 45 extending from the rear of the trip unit 17 as shown in FIG. 4. The central groove 46 extending around the stud facilitates the retention of the trip unit by engaging the edges of the keyhole slot when the tab 39A is in the position indicated in FIG. 3A and when the slide 39 is moved to the position shown in FIG. 3B the slide no longer blocks the retainer aperture 40 and the retainer stud can be inserted. The slide returns to the lock-out position of FIG. 3A under the return bias provided by the stretched extension spring 53 when the tab 39A is released. In the event that the circuit breaker is operational when an attempt is made to remove the retainer stud 45 within the retainer aperture and the slide 39 is in the interlock position of FIG. 3A, a lever 44 shown in phantom, contacts retainer tab 39B extending from the slide 39 and prevents the slide from being moved to the position of FIG. 3B. Withdrawal of the lever from the retainer tab readily allows the slide to be moved to the position of FIG. 3B to allow the retainer stud to be removed from the retainer aperture 40 to remove the trip unit from the accessory-trip unit support 29 and thereby allow the trip unit to be interchanged only when the circuit breaker is in the de-energized position.

Figure 5:
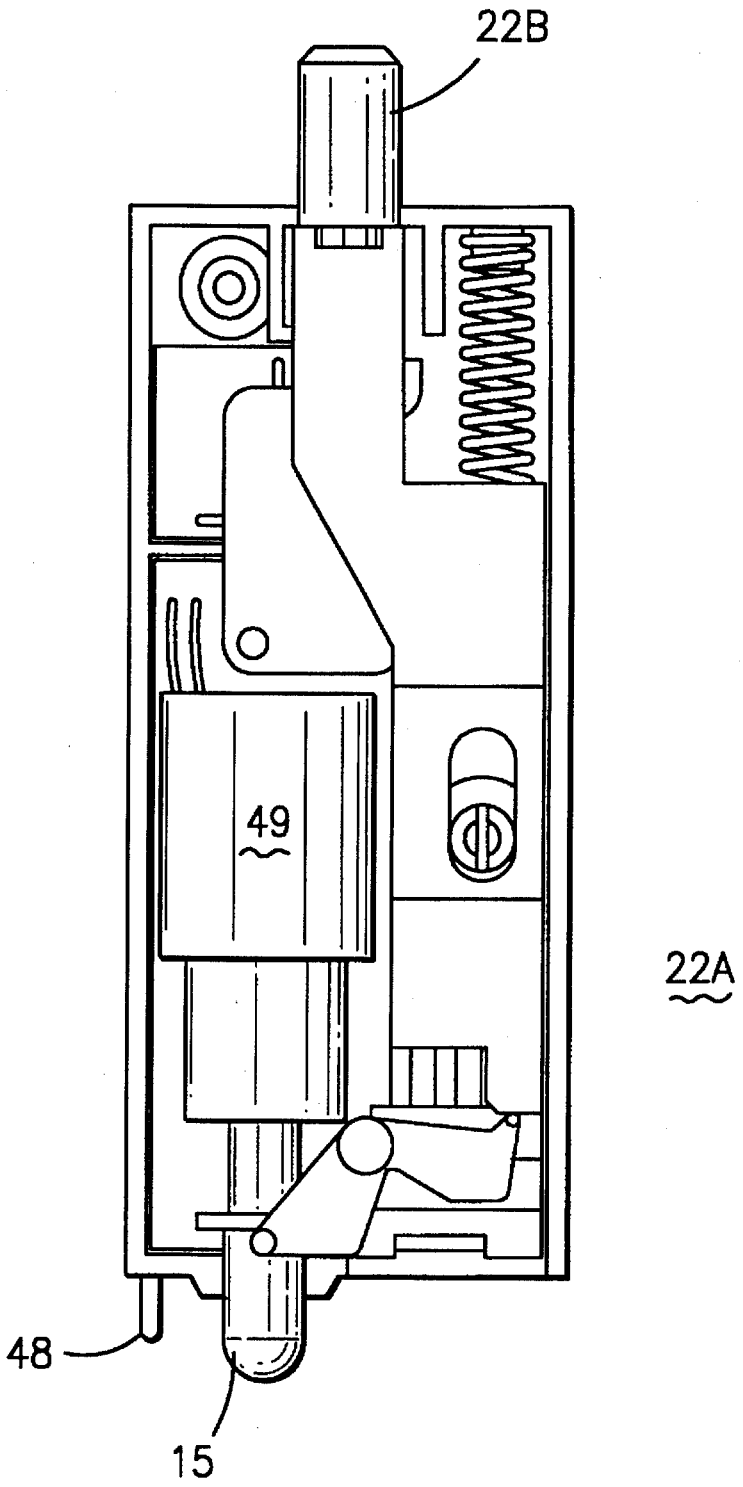
FIG. 5 is an enlarged front view of the bell alarm and lock-out accessory of FIG. 1.

The bell alarm and lock-out unit 22A is shown in FIG. 5 as one example of an accessory unit that is retained within the accessory housing 31 of FIG. 2. As described within the aforementioned U.S. patent application Ser. No. 08/248,908 entitled "Bell Alarm and Lock-out Accessory for a Digital Circuit Interrupter", the trip indicating and reset button 22B interacts with the flux shifter 49 to signal a trip occurrence as well as providing means to allow the circuit breaker operating mechanism to be reset. The plunger 15 extending from the bottom of the flux shifter and prevents the circuit breaker operating mechanism from being turned on unless the button 22B is depressed. The position of the rejection pin 48 extending from the bottom of the bell alarm and lock-out accessory shown in FIG. 5 is keyed relative to a rejection aperture 51 formed in the bottom support plate 52 of FIG. 2 to insure that a proper accessory unit is received within the associated accessory compartment 32 and that the contacts 54 (FIG. 5) on the bell alarm and lock-out accessory connector 55 (FIG. 5) electrically connect with the corresponding receptacles 28 on the bottom of the recess 24 shown in FIG. 2.

We claim:

1. An industrial-rated circuit breaker for high level overcurrent protection comprising:

an insulative circuit breaker cover arranged on an insulative base;

a recess in said circuit breaker cover;

a support within said recess;

an electronic trip unit on a first part of said support and arranged for interrupting circuit current upon occurrence of an overcurrent condition, said trip unit including a keypad and display for entering and displaying trip parameters;

retainer means on said first part arranged for securing said trip unit to said support;

a retainer stud extending from said trip unit, said retainer stud being received within said retainer means when said trip unit is inserted within said recess; and an accessory housing on a second part of said support for receiving a plurality of circuit breaker accessories.

2. The industrial-rated circuit breaker of claim 1 including terminal means on said first part arranged for electrically connecting said trip unit with electrical components.

3. The industrial-rated circuit breaker of claim 1 including receptacle means within said recess and arranged under said second part for receiving connectors on a bottom of said circuit breaker accessories.

4. The industrial-rated circuit breaker of claim 1 wherein said accessory housing includes a plurality of compartments.

5. An industrial-rated circuit breaker for high level overcurrent protection comprising:

an insulative circuit breaker cover arranged on an insulative base;

a recess in said circuit breaker cover; a support within said recess; an electronic trip unit on a first part of said support and arranged for interrupting circuit current upon occurrence of an overcurrent condition, said trip unit including a keypad and display for entering and displaying overcurrent set points;

retainer means on said first part arranged for securing said trip unit to said support;

a retainer stud extending from said trip unit, said retainer stud being received within said retainer means when said trip unit is inserted within said recess; and a retainer slide on said first part interacting with said retainer means and said retainer stud thereby preventing said retainer stud from being removed when an associated circuit breaker is operational.

6. The industrial-rated circuit breaker of claim 5 wherein an interlock means comprises a slide arranged under said retainer means, said slide including a slot having a first radial end and a second radial end, said second radial end being larger than said first radial end, whereby said first radial end underlies said retainer means and prevents said retainer stud from being removed therein when said associated circuit breaker is operational.

7. The industrial-rated circuit breaker of claim 6 wherein said slide comprises an elongated plate terminating at an access tab at one end and includes an elongated support slot.

8. The industrial-rated circuit breaker of claim 7 wherein said slide is attached to said first part by a stud.

9. The industrial-rated circuit breaker of claim 8 wherein said slide further includes a retainer tab on one side thereof, said retainer tab interfering with a part of said associated circuit breaker when said circuit breaker is in said operational condition to thereby prevent said slide from moving out of interference with said retainer means.

10. The industrial-rated circuit breaker of claim 9 including an accessory unit within an accessory housing whereby said second radial end underlies said retainer means and allows said retainer stud to be received therein when said associated circuit breaker is free from said operational condition.

11. The industrial-rated circuit breaker of claim 10 wherein said accessory unit includes a rejection pin extending from a bottom thereof, said rejection pin being received within a corresponding rejection aperture.

12. The electronic trip unit of claim 11 including a battery compartment 20 within said recess.

13. A trip unit and accessory assembly for an industrial-rated circuit breaker comprising:

a support arranged for insertion within a recess formed within an insulative circuit breaker cover arranged on an insulative circuit breaker base;

an electronic trip unit on a first part of said support and arranged for interrupting circuit current upon occurrence of an overcurrent condition, said trip unit including a keypad and display for entering and displaying overcurrent set points;

retainer means on said first part arranged for securing said trip unit to said support; and an accessory housing on a second part of said support for receiving a plurality of circuit breaker accessories.

14. The trip unit and accessory assembly of claim 13 including terminal means on said first part arranged for electrically connecting said trip unit with electrical components within said circuit breaker cover.

15. The trip unit and accessory assembly of claim 13 including receptacle means within said recess and arranged under said second part for receiving connectors on a bottom of said circuit breaker accessories.

16. The trip unit and accessory assembly of claim 13 wherein said accessory housing includes a plurality of compartments.

17. A trip unit and accessory assembly for an industrial-rated circuit breaker comprising:

a support arranged for insertion within a recess formed within an insulative circuit breaker cover arranged on an insulative circuit breaker base;

an electronic trip unit on a first part of said support and arranged for interrupting circuit current upon occurrence of an overcurrent condition, said trip unit including a keypad and display for entering and displaying overcurrent set points;

retainer means on said first part arranged for securing said trip unit to said support;

a retainer stud extending from said trip unit, said retainer stud being received within said retainer means when said trip unit is inserted within said recess; and interlock means on said first part interacting with said retainer means and said retainer stud thereby preventing said retainer stud from removal from said retainer means when an associated circuit breaker is in an operational condition.

* * * * *